United States Patent [19]

Krasser et al.

[11] Patent Number: 4,814,738

[45] Date of Patent: Mar. 21, 1989

[54] OVERLOAD PROTECTION SWITCH

[75] Inventors: Fritz Krasser; Erhard Pietsch, both of Altdorf, Fed. Rep. of Germany

[73] Assignee: Ellenberger & Poensgen GmbH, Altdorf, Fed. Rep. of Germany

[21] Appl. No.: 103,710

[22] Filed: Oct. 2, 1987

[30] Foreign Application Priority Data

Oct. 2, 1986 [DE] Fed. Rep. of Germany ... 8626325[U]

[51] Int. Cl.[4] ..... H01H 71/16

[52] U.S. Cl. ..... 337/66; 337/74

[58] Field of Search ..... 337/66, 70, 71, 72, 337/73, 74

[56] References Cited

U.S. PATENT DOCUMENTS 3,686,602 8/1972 Davis ..... 337/66
4,044,325 8/1977 Krasser ..... 337/66

FOREIGN PATENT DOCUMENTS 2123765 5/1972 Fed. Rep. of Germany .
2502579 2/1977 Fed. Rep. of Germany .
753274 10/1933 France .
2258698 1/1974 France .

*Primary Examiner*—H. Broome
*Attorney, Agent, or Firm*—Spencer & Frank

[57] ABSTRACT

An overload protection switch having a push button for manually initiating actuation of the overload protection switch and a movable contact member forming a switching path and having at least one fixed contact. There is a lockable trip mechanism actuated by the push button for controlling the movable contact member during actuation of the overload protection switch and a bimetal element which includes a locking lever pivotal into a locking position and pivotal into its unlocking position. A trip slide is articulated to the movable contact member and is charged in a turn-off direction. The trip slide is additionally supported in its path of movement by a housing groove at a counterslope fixed to the housing. An essentially wedge-shaped inner angle is formed to reduce friction forces at the locking lever and produce a lower tripping force at the bimetal element.

17 Claims, 5 Drawing Sheets

OVERLOAD PROTECTION SWITCH

BACKGROUND OF THE INVENTION

The invention relates to an overload protection switch.

The tripping mechanism or latch of an overload protection switch essentially includes a movable contact member which closes the switching path of the switch by lying against one or a plurality of fixed contacts. To ensure rapid switch-off in the case of an overload, the movable contact member is charged with spring tension in the turn-off direction directly or by way of latch components which are articulated thereto. In its OFF position, the contact member is locked directly or by means of latch components—here the so-called trip slide—connected therewith in an articulated manner by means of a locking lever. The latter can be pivoted into its locking position and is pivotal into its unlocking position by means of a thermal and/or electromagnetic tripping member or by the manual actuation of the switch against a resetting force. The movable contact member is fixed in its ON position in that the trip slide, which is hinged to the movable contact member, is supported on an abutment face of the end of the locking lever which, in its locking position, projects into the defined path of movement of the trip slide. The path of movement of the trip slide may here be initiated by it being guided in a housing groove or the like. Also conceivable is a link chain coupling of the trip slide which transfers a structurally required on/off movement of the movable contact member to the trip slide. The only important thing is that during the on/off movement, the trip slide travels a path which is defined with respect to position and direction.

In principle, the overload tripping members of a tripping mechanism need to generate tripping forces to pivot the locking lever into its unlocking position. During the unlocking process, counterforces must be overcome which are composed, inter alia, of friction forces at the point of locking and of leverage forces resulting from the spring charging the locking lever in the locking direction. To ensure rapid response of the overload protection switch and thus high switching performance, these counterforces and thus the tripping forces to be generated by the overload circuit breakers should be kept as small as possible.

In the known solutions of this problem in the art, it is customary, for example, to step down the contact-making and turn-off forces by way of a toggle lever system. Although this brings satisfactory results with respect to the magnitude of the tripping forces to be generated, toggle lever systems are structurally complicated and involve correspondingly high costs for components and installation of the tripping mechanism.

SUMMARY OF THE INVENTION

It is the object of the invention to provide an overload protection switch including a locking device for its tripping mechanism in which the tripping forces to be generated by the tripping members can be kept particularly low.

Accordingly, the total forces acting on the lock are stepped down by dividing the lock into two partial components. The path of movement of the trip slide is such that its end facing in the turn-off direction lies against the abutment face of the locking lever and additionally against a counterslope fixed to the housing. The abutment face of the locking lever and the counterslope here form a wedge-shaped inner angle region which opens in the turn-off direction of the trip slide. Thus, the total force is divided in the manner of a force parallelogram and acts partially on the counterslope and only a fraction of it acts on the actual latch between trip slide and locking lever. The latch is thus charged with less force so that friction and leverage forces are reduced considerably.

The counterslope fixed to the housing is disposed at a greater angle to the turn-off direction than the abutment face of the locking lever. Thus, the division of forces into partial components is shifted in favor of a reduced force acting on the abutment face. If this measure is combined, particularly favorable force relationships result for the locking device. Therefore, if the counterslope fixed to the housing and the abutment face of the locking lever form an obtuse inner angle region of about 90°—i.e., for example between 75° and 105°—and at the same time the counterslope is disposed at a greater angle, for example an angle four times as great as the angle formed by the abutment face with respect to the turn-off direction, a large percentage of the turn-off forces is supported by the housing slope. The remaining force component acting on the latch is thus reduced further. However, due to the geometry involved, this force component is still so high that, after the locking lever has pivoted into its unlocking position, the trip slide is able to slide down along the counterslope under the influence of this partial component to thus be able to be moved into the OFF position of the tripping mechanism together with the contact member.

An advantageous configuration for the supporting end of the trip is disclosed as a journal pin which is guided in a long-hole like housing groove so that a dual function is realized. At its supporting end, the trip slide is guided along a defined path of movement; secondly, the pin shape produces two point-shaped or at least linear contact regions for the trip slide at the counterslope and at the abutment face of the locking lever. Thus the points of attack of the partial components of the turn-off force are unequivocally fixed, and defined force relationships result which can be reproduced from switching cycle to switching cycle. Moreover, a housing groove constitutes a structurally very simple measure to realize guidance of a movable component along a defined path.

An advantageous embodiment of the housing groove is disclosed. Accordingly, the counterslope fixed to the housing is formed in a simple manner by an oblique offset of the housing groove disposed in the overlap region with the end of the locking lever and facing away therefrom. The offset slope itself may here be a planar surface which changes at an obtuse angle into the adjacent linear regions of the housing groove on both sides, but a flat, S-shaped curve is also conceivable.

Also, there is disclosed a measure with which additional leverage forces to be overcome by the tripping forces of the tripping members are avoided during pivoting of the locking lever into its unlocking position. The abutment face of the locking lever is here configured as a convex cylinder segment face whose radius corresponds essentially to the distance between the abutment face and the fulcrum of the locking lever. This does not change the distance of the position of the journal pin from the fulcrum of the locking lever if the latter is pivoted. If this distance were to increase, the tripping members would have to overcome an additional force component which results from the displacement of the journal pin against the turn-off force possibly acting on the trip slide by way of the movable contact member.

Further advantageous features of the invention relate to a push-button actuated overload protection switch. The latter is thus essentially a modification of the push-button actuated excess current switch with thermal tripping according to German Pat. No. 2,502,579. The prior art overload protection switch is equipped with an instantaneous on/off switch, thermal as well as trip-free release. It includes a contact bridge support in the form of a double-armed angle lever which is pivotal and displaceable in the switching plane, with the bridge support including a guide arm disposed essentially at a right angle to the actuation direction of the push button and spring charged in the direction opposite thereto as well as a support arm disposed essentially parallel to that direction to the side of the push button. The contact bridge is fastened to the free end of the support arm so as to establish a contact connection between two fixed contacts. The support arm can be latched together with the inner end of the push button so as to transfer its turn-on movement to the contact bridge support. The manner of latching disclosed in the cited publication results in a sudden, instantaneous turn-on of the contact bridge.

In the prior art overload protection switch, the charging force generated by the turn-off spring acts in its full force in the turn-off direction on the latch of the contact bridge support and the detent protuberance at the end of the movement of the bimetal element. This structure has the above-mentioned drawbacks.

Due to the fact that the guide arm of the contact bridge support extends beyond the push button in the interior of the housing and because of the articulated connection of the free end of the guide arm with the trip lever of the latching device, which is movable along a path of movement parallel to the actuation direction of the push button, the prior art overload protection switch is modified in such a manner that the tripping forces to be generated by the overload tripping members are particularly low. This shortens the response time of the overload protection switch according to the invention and greater turn-off power can be realized. Moreover, due to the reduced friction forces at the mutually contacting faces, the locking device is subjected to less wear. Thus abrasion, deformation of material and the like within the tripping mechanism are avoided or at least suppressed to a great extent so that the service life of the overload protection switch is extended and close tripping tolerances can be maintained over a longer period of operation.

By configuring the overload protection switch, the trip slide is converted with simple structural means to a one-armed trip lever disposed essentially parallel to the housing groove, with its pivot axis being its journal pin which is longitudinally displaceable in the housing groove. Thanks to this configuration, the trip lever can be given further functions to perform which will be defined hereinafter.

To permit the trip lever to pivot, the articulated connection between the guide arm of the contact bridge support and the trip lever must permit mutual displacement of these two parts in the direction of rotation of the trip lever. Correspondingly, the articulated connection is formed by engagement of the free end of the guide arm in a receiving aperture extending at a right angle to the actuation direction at the articulated end of the trip lever disposed opposite the journal pin. Engagement preferably occurs with play, thus carrying the trip lever reliably along when the contact bridge support performs its turn-on movement, while the above-mentioned pivoting movement of the trip lever about its journal pin is possible within certain limits.

An advantageous additional function can be performed by the trip lever. The trip lever of the locking device here has an actuating arm which extends approximately parallel to the trip lever within pivoting range of the latter. By means of this actuating arm, the trip lever, by pivoting about the journal pin, is able to move the locking lever out of its locking position into the unlocking position.

This means that the manual actuating means or the thermal and/or electromagnetic actuating members are able to act on various components of the trip mechanism to cause the trip mechanism to be unlocked. For example, the moving end of the bimetal element may directly charge the locking lever, its actuating arm or even the trip lever in the unlocking direction. It remains at the discretion of the design engineer at which point he places, for example, the bimetal element in the manner he deems advantageous. The configuration according to the invention here leaves him various possibilities of selection as to where to place the corresponding tripping member and in which way he lets it act on the locking device.

One possible embodiment of the subject matter of the invention is disclosed, according to which the trip lever, in its locking position, can be pivoted about its journal pin in the direction of unlocking by actuation of the push button. This pivoting movement may be transferred to the locking lever which thus itself can be moved to the unlocked position and thus releases the lock of the trip lever and thus of the contact bridge support. Since now the push button and the thermal tripping member are able to engage at different components of the trip mechanism, the trip mechanism structure is given an advantageous functional organization and thus is structurally simplified The measure constitutes a particularly simple way of forming the receiving aperture of the trip lever for the free end of the guide arm. The studs for forming the receiving aperture may here perform further functions. The inner one of the two studs facing the journal pin is charged by a tension spring which is fastened to the guide arm of the contact bridge support approximately at a right angle to the actuation direction of the push button in such a manner that it constantly lies against the side edge of the push button facing the locking device and extending parallel to the actuation direction. Thus, in spite of its possible rotatability about its journal pin, the trip lever takes on a defined position in every switching position of the trip mechanism. Due to the unequivocal relationship between the positions of the side edge of the push button and the inner stud of the trip lever, the side edge can be utilized to control the rotary movement of the trip lever. Correspondingly, this side edge of the push button has a shaped-on abutment slope which forms an obtuse angle with the actuation direction of the push button and, when the push button performs the turn-off movement, the trip lever and, by way of it, the locking lever can be charged in the unlocking direction. The control of the rotary movement by way of an abutment slope here constitutes a particularly simple structural solution.

The lateral, mutually facing abutment protuberances at the trip lever and at the actuating arm of the locking lever ensure immediate transfer of the pivoting movement of the trip lever to the locking lever.

In the sum of the advantages of the invention, an overload protection switch is created which is structurally simple, well organized and consequently has a very compact structure but nevertheless incorporates all switching technology advantages, such as instantaneous turn-on and turn-off and trip-free release and, additionally, produces a high turn-off performance with long-term switching behavior within close tolerances.

The invention will be described in greater detail below with reference to an embodiment and the attached drawing figures.

DESCRIPTION OF THE PREFERRED EMBODIMENTS

Figure 1:
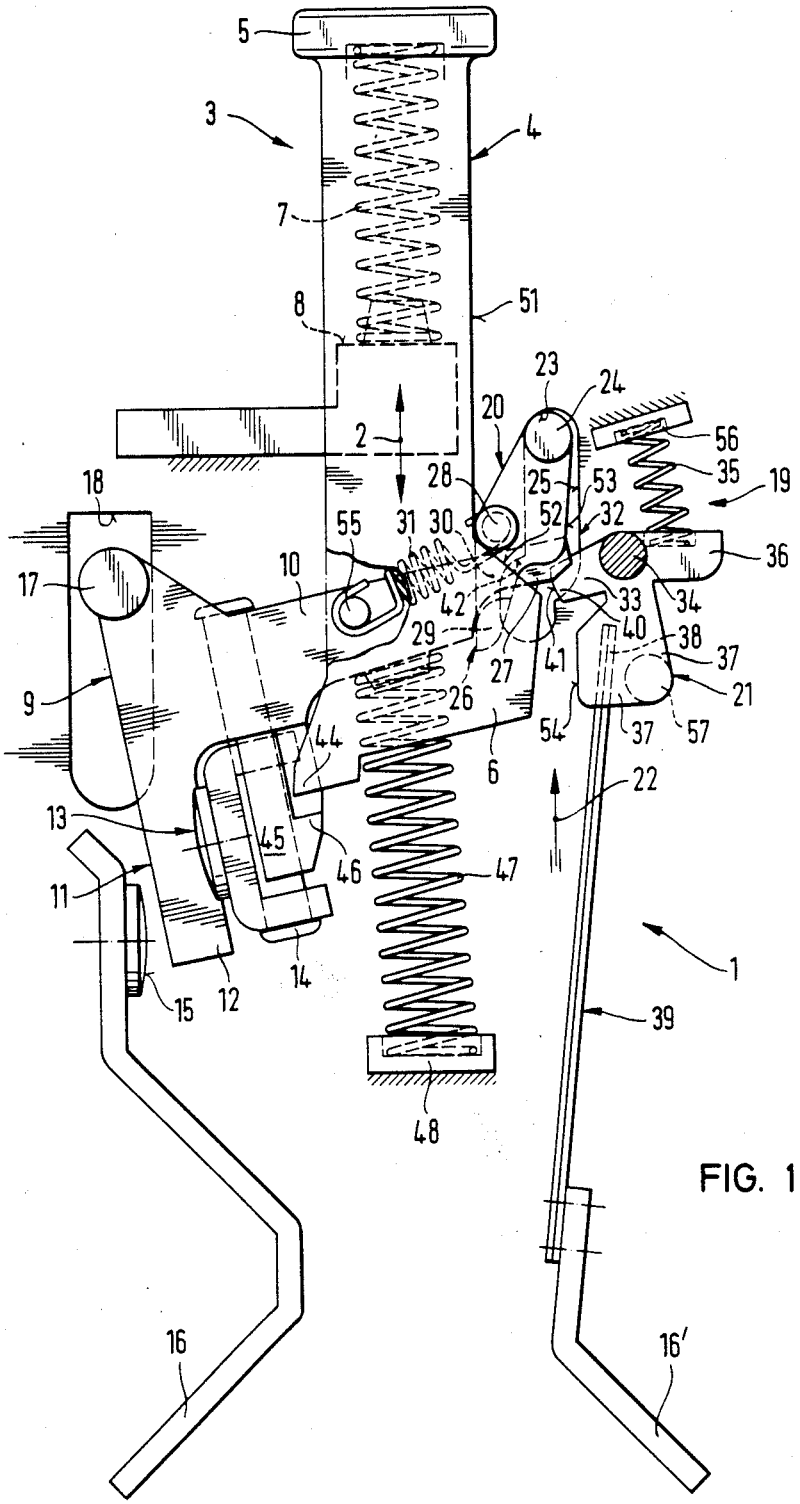
FIG. 1 is a schematic view of the overload protection switch including trip mechanism and push button in the OFF position.

The trip mechanism 1 resting in two housing half shells (not shown) is actuated by a push button 3 which is longitudinally displaceable in the actuation direction 2. This push button is configured as an elongate slide element 4 whose gripping end 5 projects from the housing. Its inner end 6 is disposed within the housing in the region where it overlaps trip mechanism 1. Push button 3 is charged in the turn-off direction by a helical compression spring type turn-off spring 7 which engages in the region of its gripping end 5. If trip mechanism 1 has been actuated, turn-off spring 7 automatically moves push button 3 into the OFF position shown in FIG. 1. For this purpose, turn-off spring 7 is supported by an abutment 8 which is fixed to the housing.

The major components of the trip mechanism 1, which essentially lie next to one another in the switching plane, will be described with reference to FIG. 1. The switching plane is here understood to be the plane in which the pivoting and displacing movements of the switching mechanism take place. In the illustrated embodiment, this plane essentially coincides with the plane of the drawing.

On the side of the inner end 6 of push button 3, there is disposed a contact bridge support 9 which is configured as an angle lever. This lever is essentially composed of a guide arm 10 disposed at a right angle to the actuation direction 2 of push button 3 and passing by inner end 6 toward the opposite side as well as a supporting arm 11 disposed essentially parallel to the actuation direction 2. A contact bridge 13 is fastened to a free end 12 of supporting arm 11 by means of a rivet 14 which passes through contact bridge support 9. Contact bridge 13 is disposed approximately at a right angle to the switching plane and connects the two lateral fixed contacts 15 which are flush with one another in this direction and of which only the contact facing the observer is shown in the drawing figures. The frontal fixed contact 15 is connected via a connecting lug 16 with a connecting terminal and the corresponding connected line. The rear fixed contact is in conductive connection with a bimetal element 39 which contacts, via its connecting lug 16', the second connected line. The connected line and connecting terminal for connecting lug 16 and the rear fixed contact are omitted in the drawing figures for the sake of clarity.

In the transition region between its guide arm 10 and its support arm 11, contact bridge support 9 in the form of the angle lever is provided with a bearing pin 17 which is disposed transversely to the switching plane and is displaceably guided in a guide groove 18 extending to the side of push button 3 and parallel to its actuation direction 2. Correspondingly, contact bridge support 9 is able to perform a sliding movement as well as a pivoting movement in the switching plane. Guide groove 18 and fixed contacts 15 are here disposed essentially in the extension of a line parallel to actuation direction 2 of push button 3. On the side of push button 3 opposite these components, there is disposed a latching device 19 of the trip mechanism 1. This device is essentially composed of a one-armed trip lever 20 disposed parallel to actuation direction 2 directly next to push button 3 and a T-shaped locking lever 21 disposed next to it. A bearing end 23 of the trip lever 20 is oriented in the turn-off direction 22 and has a shaped-on journal pin 24 extending transversely to the switching plane so as to engage in a housing groove 25. The groove 25 is extending essentially parallel to the actuation direction 2 of push button 3 and is extending laterally thereto. The journal pin 24 is guided so as to be longitudinally displaceable. The trip lever 20 may perform a pivoting movement about journal pin 24 in the switching plane. The free end of trip lever 20, serving as the hinge end 26, is articulated to the free end 27 of guide arm 10 of contact bridge support 9. For this purpose, free end 27 engages between two studs 28, 29 attached to trip lever 20 and spaced transversely to the switching plane when seen in the turn-off direction 22. These studs thus form a receiving aperture 30 for the free end 27 which, compared to the remaining width of guide arm 10, is tapered. Stud 28, which lies closer to journal pin 24, serves as a point of attack for a coil-type tension spring 31 which is fastened by means of a pin 55 to the center region of the guide arm 10 for contact bridge support 9.

Housing groove 25 has the shape of a long hole and, in its lower region, is provided with an offset slope 32 which causes the lower end of housing groove 25 to be offset in the direction toward push button 3. The locking arm 33 of the T-shaped, three-armed locking lever 21 is disposed in the region of the offset slope 32. This lever is pivotally mounted in a pivot bearing 34 at the point of intersection of its T-shaped horizontal and vertical arms. The lever is charged in the locking direction (i.e., clockwise, with respect to the drawing figures) by a coil-type compression spring 35 supported at a stop 56 on the housing. This spring acts on a charging arm 36 (locking force V, see FIG. 5) which faces away from locking arm 33. Locking arm 33 and charging arm 36 together form the horizontal T arm of locking lever 21. The vertical T arm is formed by an actuation arm 37 which is approximately parallel to the actuation direction 2 of push button 3 and at which engages the moving end 38 of the bimetal element 39 that acts as the thermal tripping member. In the region of the offset slope 32, the free end 40 of locking arm 33 is in congruence with housing groove 25. In the locking position, an abutment face 41 at the free end 40 of locking arm 33, which face is a cylinder segment face disposed transversely to the switching plane, and oppositely disposed counterface 42 of the offset slope 32 form an inner angle region 43 which opens in the form of a wedge toward turn-off direction 22. The function of this inner angle region 43 becomes clear from the description of the switching kinematics of trip mechanism 1.

Figure 2:
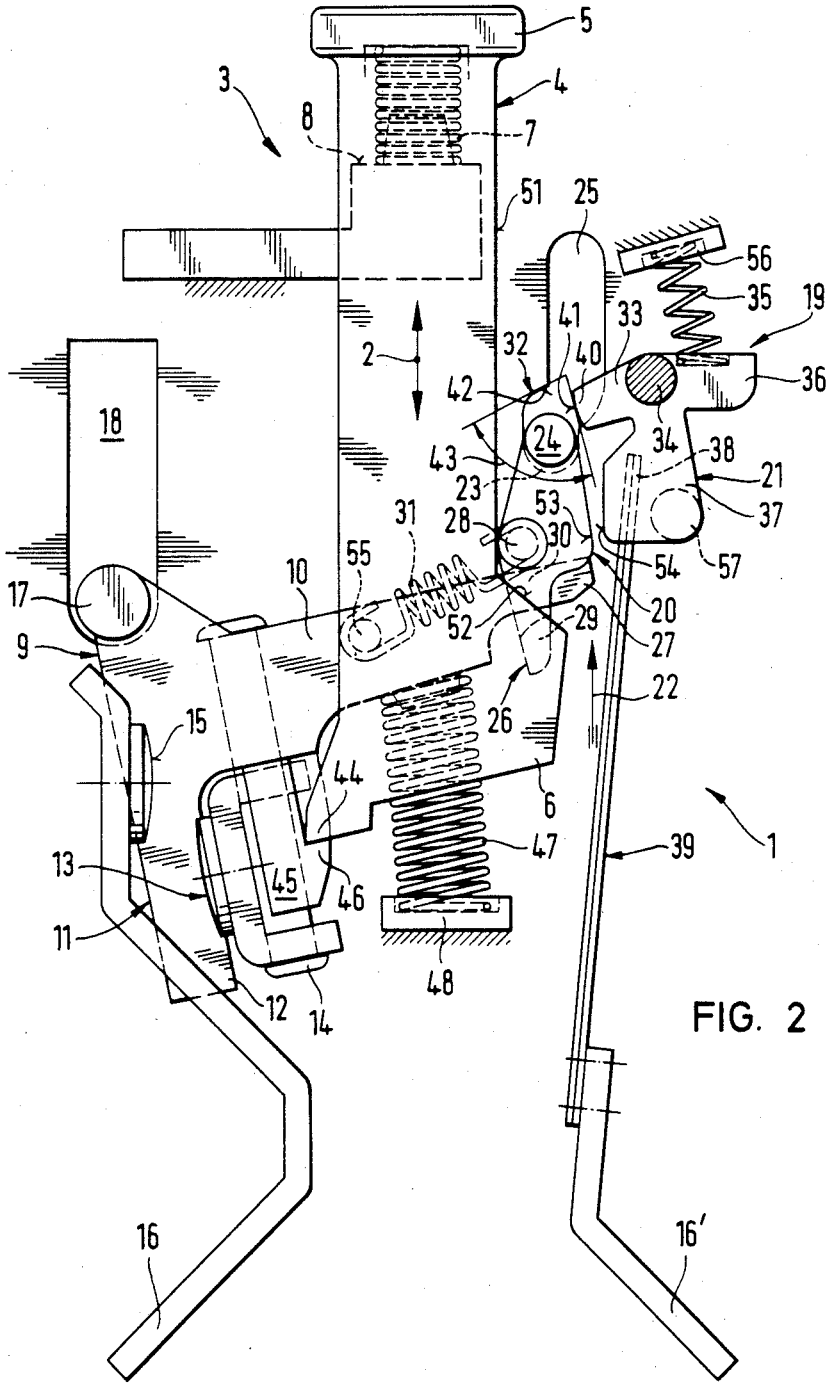
FIG. 2 is a view according to FIG. 1 shortly before reaching the ON position.

FIG. 1 shows the overload protection switch in its OFF position. Contact bridge support 9, push button 3 and trip lever 20 are in their extreme upper positions, with contact bridge support 9 being slightly tilted counterclockwise with respect to FIG. 1 about its journal pin 17. If push button 3 is actuated (FIG. 2), its detent protuberance 44 attached to the side of its inner end 6 engages in a detent recess 46 provided on the rear side 45 of contact bridge support 9 facing away from fixed contacts 14. This causes contact bridge support 9 to be carried along against the charging force of a contact pressure spring 47 clamped in between guide arm 10 and a stop 48 fixed to the housing. Contact bridge support 9 is thus displaced only longitudinally but remains in its tilted state. The longitudinal displacement of contact bridge support 9 cause it to carry along trip lever 20, thus moving its journal pin 24 downwardly in housing groove 25. Passage over offset slope 32 then brings locking arm 33 of locking lever 21 briefly into its unlocking position out of congruence with housing groove 25 (not shown), overcoming the force exerted by coiltype compression spring 35, and journal pin 24 snaps over locking lever 21. The push button is pushed into the housing until it reaches the extreme position shown in FIG. 2. At that time, contact bridge 13 does not yet lie against fixed contacts 15, contact pressure spring 47 is at maximum tension and locking lever 21, under the influence of coiltype compression spring 33, is brought back into its locking position in congruence with housing groove 25.

If push button 3 (FIG. 3) is released, the components of the trip mechanism move back in turn-off direction 22. However, this occurs only until journal pin 24 stops at the inner angle region 43 (see FIG. 5) formed by abutment face 41 and counterslope 42 and is locked there.

During this movement, the inner stud 28 of the trip lever acts as a fixed fulcrum for contact bridge support 9 which, under the influence of contact pressure spring 47, now tilts clockwise, thus enabling push button 3 to be displaced a short distance with respect to contact bridge support 9 in turn-off direction 22. Detent protuberance 44 of push button 3 thus soon comes out of engagement with detent recess 46 at contact bridge support 9, causing the latter to be suddenly pushed into the ON position shown in FIG. 3. Thus, the overload protection switch according to the invention ensures instantaneous turn-on independent of manual operation.

The forces acting on locking device 19 in this position will be described with reference to FIGS. 3 and 5. Contact pressure spring 47 makes available not only the contact pressure itself but also the turn-off force which tears contact bridge support 9 away from fixed contacts 15 in turn-off direction 22. This turn-off force A is transferred by way of guide arm 10 to trip lever 20 and charges the latter in turn-off direction 22. Due to the fact that journal pin 24 lies against inner angle region 43, turn-off force A is divided, in the manner of a force parallelogram, into two partial components F1, F2. Because of the arrangement of counterslope 42 and abutment face 41 at an angle of about 80° with respect to one another according to FIG. 5, partial component F2 which acts on abutment face 41, is reduced. This effect is augmented by the measure that the angle 49 of about 64° between counterslope 42 and turn-off direction 22 is substantially greater than the angle 50 of about 15° between abutment face 41 and this direction 22. The reduction of partial component F2 causes the friction forces between journal pin 24 and locking lever 21 to be reduced so that the unlocking forces E to be generated by the tripping member are lower. In the embodiment according to FIG. 3, this means that bimetal element 39 need make available a lower tripping force. The thermal actuation of trip mechanism 1 is effected in a simple manner in that bimetal element 39, when it bends due to the influence of temperature (not shown), charges the abutment protuberance 57 at actuating arm 37 and pivots locking lever 21 counterclockwise in FIG. 3 about pivot bearing 34, thus causing abutment face 41 to move out of congruence with housing groove 25. Journal pin 24 is thus able to slide past locking lever 21, releasing trip lever 20 and thus contact bridge support 9 and bringing them, under the influence of contact pressure spring 47, into the turn-off position shown in FIG. 4.

Figure 3:
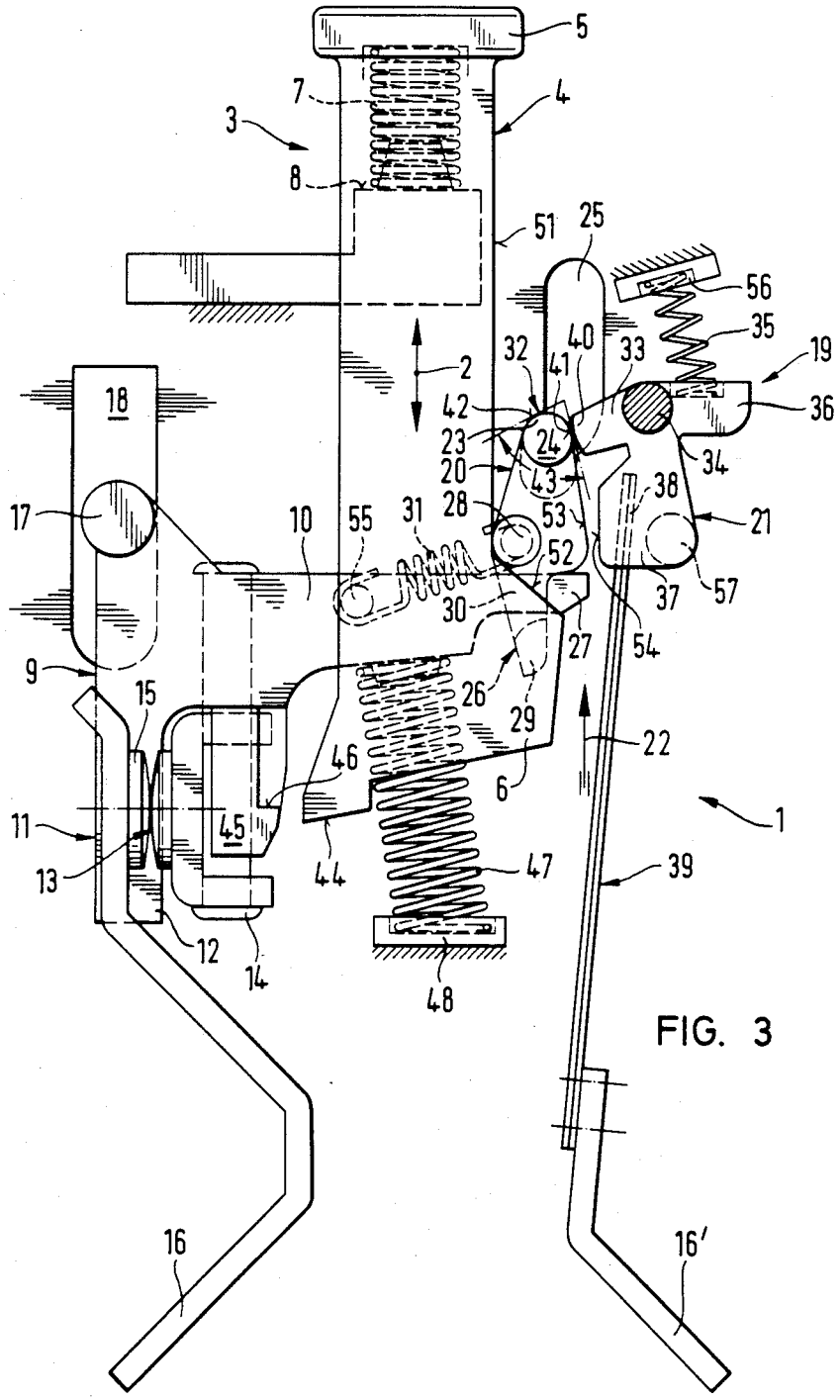
FIG. 3 is a view according to FIG. 1 in the locked ON position of the switch.
Figure 4:
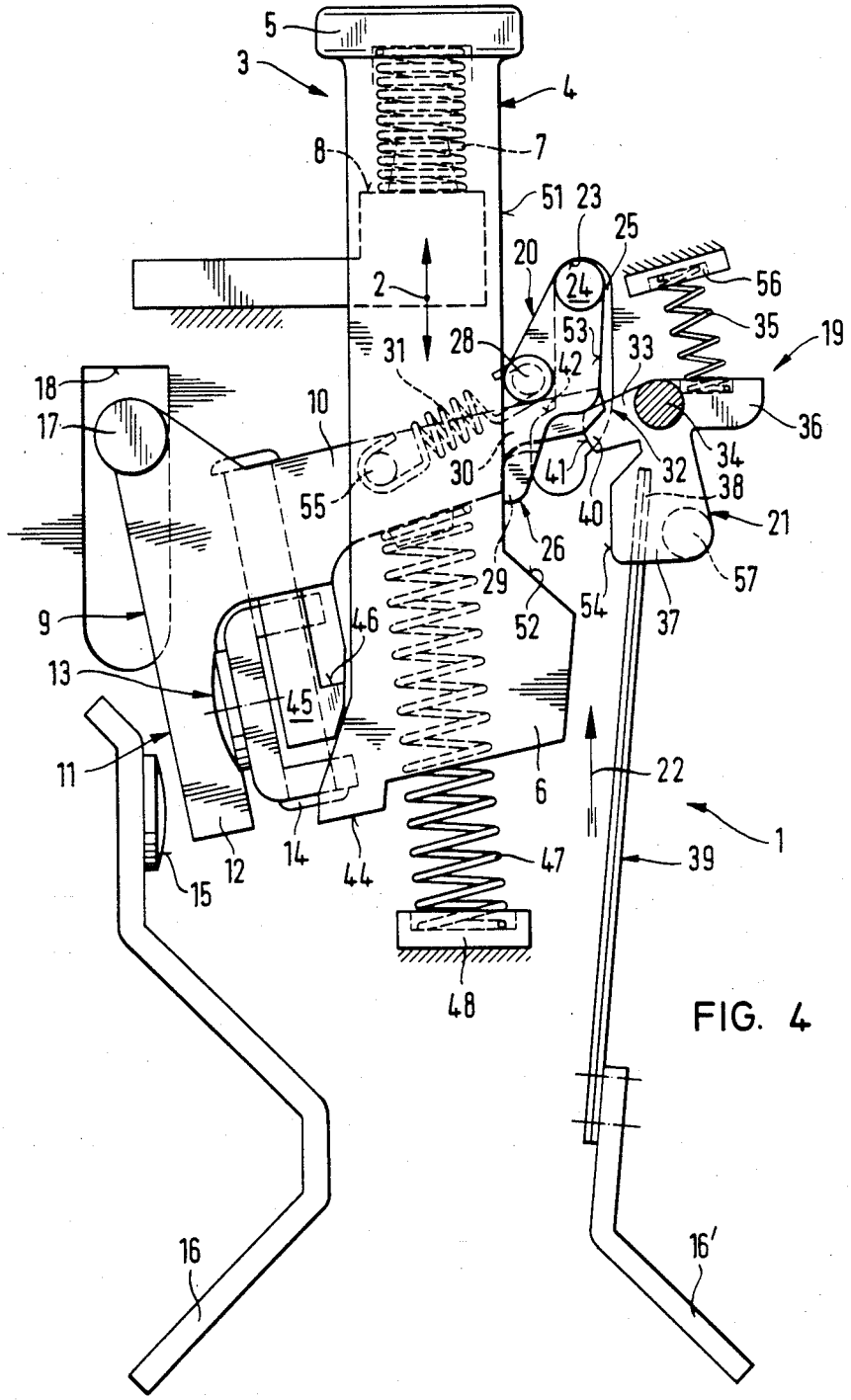
FIG. 4 is a view according to FIG. 1 in the "trip-free release" position.
Figure 5:
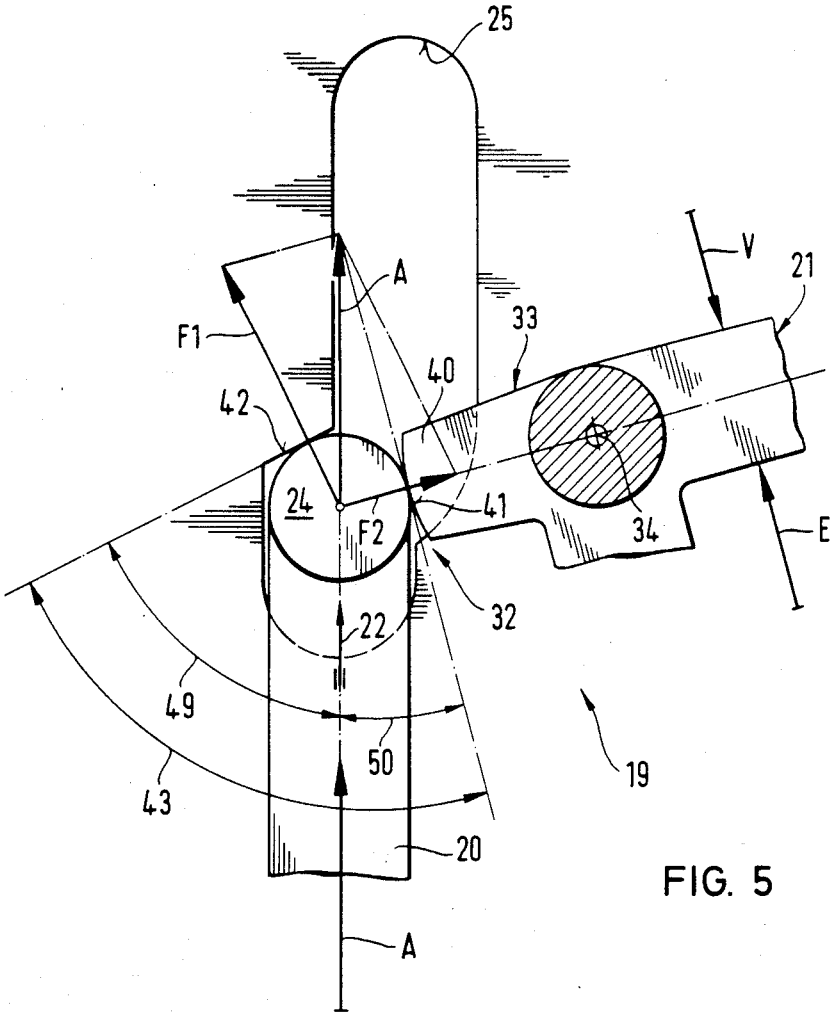
FIG. 5 is a basic sketch of the locking device of the overload protection switch.

As can be seen in FIGS. 3 and 4, push button 3 may then be retained in its turn-on position; nevertheless, this does not influence the tripping movement of the contact bridge support (trip-free release). Detent recess 46 is now unable to come into engagement with detent protuberance 44 of the push button which could prevent the turn-off movement.

Manual turn-off by way of push button 3 will be described with reference to FIG. 3. The stud 28 of trip lever 20, under the influence of coil-type tension spring 31, lies against the side edge 51 of push button 3 facing locking device 19. At the appropriate position, an abutment slope 52 is shaped at this side edge 51 so as to form an obtuse angle with side edge 51. The defined ON position of push button 3 shown in FIG. 3 is maintained by the placement of journal pin 24 of trip lever 20 in the angle region between side edge 51 and abutment slope 52. The torque exerted on trip lever 20 by coil-type tension spring 31 transversely to actuation direction 2 is greater than the countertorque transferred by turn-off spring 7 via abutment slope 52 to trip lever 20. If, however, an additional tension force acts on push button 3 in turn-off direction 22—for example due to the turn-off actuation of push button 3—push button 3 is pushed upwardly and trip lever 20 is caused to rotate counterclockwise by way of abutment slope 52. The lateral abutment protuberance 53 of trip lever 20 then lies against the abutment protuberance 54 of actuating arm 37 of locking lever 21 facing it so that the latter, with increasing extraction of push button 3, is transferred to its unlocking position. This releases trip lever 20 and, in turn, contact bridge support 9 in the turn-off direction 22, causing the switch contact to be suddenly opened under the influence of contact pressure spring 47. Therefore, the turn-off movement of trip mechanism 1 is also an instantaneous turn-off independent of manual actuation, thus preventing the development of wear increasing arcs or welding together of the contacts.

Release of push button 3 from its position shown in FIG. 4, causes turn-off spring 7 to advance it in the turn-off direction 22, thus placing its detent protuberance 44 again above detent recess 46 (FIG. 1). The protective switch is again ready to be closed.

It will be understood that the above description of the present invention is susceptible to various modifications, changes and adaptations, and the same are intended to be comprehended within the meaning and range of equivalents of the appended claims.

We claim:

1. An overload protection switch comprising a manual actuation means for manually initiating actuation of said overload protection switch a movable contact member forming a switching path and having at least one fixed contact;

a lockable trip mechanism being actuated by said manual actuation means for controlling the movable contact member during actuation of said overload protection switch a bimetal element, with the trip mechanism being provided with a locking device, which includes a locking lever pivotal into a locking position and pivotal into its unlocking position by means of the bimetal element or by said manual actuation means by moving said locking lever against a resilient resetting force; and a trip slide which is articulated to the movable contact member and is charged in a turn-off direction of said overload protection switch;

with said trip slide also being moved, during a turn-on and turn-off movement of the trip mechanism for said overload protection switch, by the movable contact member along a path of movement; and the movement of said trip slide being blocked in such a manner, by its end facing in the turn-off direction of said overload protection switch and being supported at an abutment face of a free end of the locking lever projecting, in the locking position, into the path of movement, so that the movable contact member is fixed in the turn-on position of said overload protection switch; and said trip slide is additionally supported in its path of movement by a housing groove at a counterslope fixed to the housing, groove at a counterslope fixed to the housing, with the abutment face and the counterslope forming an essentially wedge-shaped inner angle region which opens toward the turn-off direction of said trip slide to reduce friction forces at said locking lever and produce a lower tripping force at said bimetal element.

2. An overload protection switch according to claim 1, wherein a housing-attached counterslope of a locking device forms a greater angle toward the turn-off direction than the abutment face of the locking lever.

3. An overload protection switch according to claim 1, wherein the locking position of said locking lever, the counterslope and the abutment face form an inner angle region of about 90°.

4. An overload protection switch according to claim 1, wherein a supporting end of the trip slide is formed by a journal pin disposed transversely to the turn-off direction and is guided in said housing groove serving as its path of movement.

5. An overload protection switch according to claim 4, wherein the region of congruence with the free end of the locking lever, the housing groove of the locking device is provided with an offset slope oriented away from said free end, with an offset side wall of said slope facing the locking lever and forming a counterslope fixed to the housing.

6. An overload protection switch according to claim 1, wherein the abutment face of the locking lever is configured as a convex cylinder segment face whose radius essentially corresponds to the distance of the counterslope from a fulcrum of the locking lever.

7. An overload protection switch according to claim 1 wherein said manual actuation means is a push button having instantaneous turn-on and turn-off, thermal, electromagnetic as well as trip-free release and a contact bridge support in the form of a two-armed angle lever which is pivotal and displaceable in the switching plane, including a guide arm disposed essentially at a right angle to the actuation direction of the push button and charged with spring pressure opposite to said direction; and a support arm disposed essentially parallel to the actuation direction of the push button on the side of said push button;

with the free end of said support arm carrying the contact bridge as the movable contact member for establishing contact between two fixed contacts disposed flush with one another transversely to the switching plane; and being latchable with an inner end of the push button for transmission of the turn-on movement of said push button to the contact bridge support, and the guide arm of the contact bridge support is brought past the push button in the interior of the housing and the free end of said guide arm is articulated to the trip slide of the locking device, said trip slide being displaceable in the path of movement of said housing groove and extending in the actuation direction of the push button.

8. An overload protection switch according to claim 7, wherein the trip slide is a single-arm trip lever disposed essentially parallel to the housing groove, with its axis of rotation being its journal pin which is longitudinally displaceable in the housing groove defining its path of movement.

9. An overload protection switch according to claim 8, the articulated connection between the guide arm and the trip lever is established by engagement of the free end of the guide arm in a receiving aperture extending at a right angle to the actuation direction at the articulated end of the trip slide disposed opposite the journal pin.

10. An overload protection switch according to claim 9, wherein the locking lever of the locking device is provided with an actuating arm extending approximately parallel to the trip slide within its pivoting range, with the locking lever being brought from the locking position to the unlocking position by means of said actuating arm when the trip slide pivots about the journal pin.

11. An overload protection switch according to claim 7, wherein, its locking position, the trip slide can be pivoted about its journal pin into the unlocking position by actuating the push button for turn-off of said overload protection switch.

12. An overload protection switch according to claim 7, wherein the receiving aperture of the trip slide is formed by two studs disposed approximately at a right angle to the switching plane and passing with play around the free end of the guide arm.

13. An overload protection switch according to claim 12, wherein the inner one of the two studs facing the journal pin is charged approximately at a right angle to the actuation direction of the push button by a tension spring fastened to the guide arm of the contact bridge support in such a manner that it constantly lies against a side edge of the push button facing the locking device and extending parallel to the actuation direction.

14. An overload protection switch according to claim 13, wherein, at the side edge of the push button facing the locking device, an abutment slope is formed which defines an obtuse angle with the actuation direction of the push button and charges the trip slide and the locking lever in the unlocking direction during the turn-off movement of the push button.

15. An overload protection switch according to claim 7, wherein the trip slide and the actuation arm of the locking lever are each provided with mutually facing lateral abutment protuberances.

16. An overload protection switch according to claim 1, wherein said bimetal element is a thermal member.

17. An overload protection swithc according to claim 1 wherein said bimetal element is a electromagnetic member.

* * * * *